US008991611B2

(12) United States Patent
Stonitsch et al.

(10) Patent No.: US 8,991,611 B2
(45) Date of Patent: Mar. 31, 2015

(54) SEPARATING A POWDER MIXTURE

(71) Applicant: General Electric Company, Schenectady, NY (US)

(72) Inventors: Raymond Joseph Stonitsch, Greenville, SC (US); George Albert Goller, Greenville, SC (US)

(73) Assignee: General Electric Company, Schenectady, NY (US)

( * ) Notice: Subject to any disclaimer, the term of this patent is extended or adjusted under 35 U.S.C. 154(b) by 100 days.

(21) Appl. No.: 13/804,991

(22) Filed: Mar. 14, 2013

(65) Prior Publication Data

US 2014/0262967 A1 Sep. 18, 2014

(51) Int. Cl.

| | |
|---|---|
| ***B03C 1/00*** | (2006.01) |
| ***B03C 1/02*** | (2006.01) |
| ***B03C 1/10*** | (2006.01) |
| ***B03C 1/247*** | (2006.01) |

(52) U.S. Cl.

CPC ... *B03C 1/02* (2013.01); *B03C 1/10* (2013.01); *B03C 1/247* (2013.01); *B03C 2201/20* (2013.01); *B03C 2201/32* (2013.01)

USPC ..... 209/214; 209/8; 209/215; 209/216

(58) Field of Classification Search

USPC ..... 209/8, 214, 215, 225–227, 230, 231, 209/636; 148/674, 676

See application file for complete search history.

(56) References Cited

U.S. PATENT DOCUMENTS

| | | | | |
|---|---|---|---|---|
| 2,560,809 | A * | 7/1951 | Martin | 209/8 |
| 5,182,253 | A * | 1/1993 | Kishi et al. | 209/2 |
| 5,535,891 | A * | 7/1996 | Kuniyone et al. | 209/12.1 |
| 7,056,400 | B1 * | 6/2006 | Spangler et al. | 148/676 |
| 2005/0167003 | A1 * | 8/2005 | Spangler et al. | 148/105 |

* cited by examiner

*Primary Examiner* — Terrell Matthews

(74) *Attorney, Agent, or Firm* — Cantor Colburn LLP

(57) ABSTRACT

A method of separating a powder mixture is disclosed. A first magnetic field is applied to the powder mixture which may contains a non-magnetic metal powder and a contaminant powder. A field strength of the first magnetic field magnetizes the non-magnetic metal powder and leaves the contaminant powder non-magnetized. A second magnetic field is applied to the powder mixture to separate the magnetized metal powder from the non-magnetized contaminant powder.

20 Claims, 3 Drawing Sheets

SEPARATING A POWDER MIXTURE

BACKGROUND OF THE INVENTION

The subject matter disclosed herein relates to separating components of a powder mixture and, in particular, to methods for using magnets to separating non-magnetic metal particles within a powder mixture.

Various industrial parts, such as engine parts are made by pressing a powder material into a die. The quality, strength, etc. of the industrial part is therefore related to the quality of the powder used to make it. Methods of preparing this powder may result in contaminant particles being deposited along with the industrial-use powder material in a powder mixture. Methods have been designed for removing the contaminants from the resulting power mixture by magnetic separation of the particles. However, current magnetic separation methods are ineffective when the powder meant for industrial use and contaminants in the powder mixture are non-magnetic.

BRIEF DESCRIPTION OF THE INVENTION

According to one aspect of the invention, a method of separating a powder mixture includes: applying a first magnetic field to the powder mixture containing a non-magnetic metal powder and a contaminant powder, wherein a field strength of the first magnetic field magnetizes the non-magnetic metal powder and leaves the contaminant powder non-magnetized; and applying a second magnetic field to the powder mixture to separate the magnetized metal powder from the non-magnetized contaminant powder.

According to another aspect of the invention, an apparatus for separating a powder mixture includes: a first magnet configured to magnetize a non-magnetic metal powder of the powder mixture and leave a contaminant powder of the powder mixture non-magnetized; and a second magnet configured to separate the magnetized metal powder from the non-magnetized contaminant powder.

According to yet another aspect of the invention, a method of separating a powder mixture includes: applying an external magnetic field to the powder mixture having a first non-magnetic powder component and a second non-magnetic powder component to magnetize the first non-magnetic component of the powder mixture and leave the second component non-magnetized; and using a second external magnetic field to separate the powder mixture into a first powder and a second powder These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
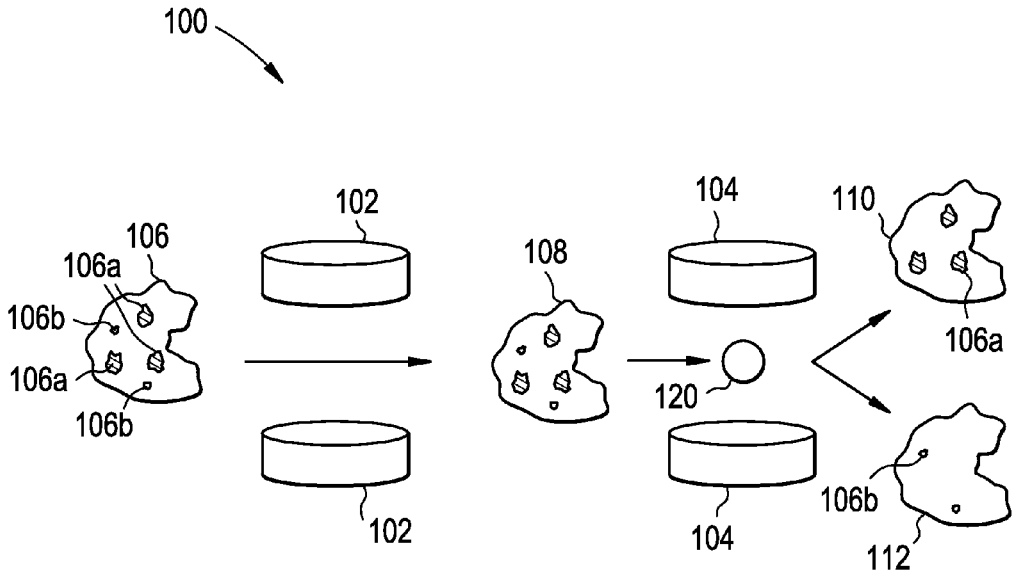
FIG. 1 shows an exemplary system for separation of a powder mixture in one embodiment of the present disclosure.

FIG. 1 shows an exemplary system 100 for separation of a powder mixture 106 in one embodiment of the present disclosure. The powder mixture 106 may include a mixture of a first powder 106*a* of inherently non-magnetic particles that are to be used in forming an industrial part and a second powder 106*b* including contaminant particles. The inherently non-magnetic particles of the first powder 106*a* may be a metal powder that is non-magnetic but that may be magnetized when subjected to a magnetic field of sufficient field strength. Exemplary non-magnetic metal powders may include, but are not limited to, superalloy metal powder such as high-alloy nickel chromium powder, non-magnetic steel powder, stainless steel powder, and a non-ferrous powder such as a copper powder. For discussion purposes, the non-magnetic metal powder may be referred to herein as a non-magnetic superalloy particle. The contaminant particles of the second powder 106*b* may include particulate forms of material used in a process that produces the first powder that are leftover in the powder mixture 106. The contaminant material of the second powder 106*b* may include brick flakes, etc. The first powder 106*a* may include particles that, although non-magnetic, may be magnetized when exposed to a magnetic field having a selected field strength, such as a superalloy metal powder. The first powder 106*a* may include non-magnetic particles that remain non-magnetic when exposed to the same magnetic having the selected field strength.

The exemplary separation system 100 may include a first magnet 102 for magnetizing the first powder 106*a* (i.e. the superalloy metal powder) of the powder mixture 106 and a second magnet 104 for separating the particles of the first powder 106*a* from particles of the second powder 106*b*. In one embodiment, the powder mixture 106 is conveyed through a first magnetic field provided by the first magnet 102 to magnetize the first powder 106*a*. Powder mixture 108 therefore contains a magnetized first powder (i.e., magnetized particles of superalloy metal) and non-magnetized second powder (i.e. non-magnetized contaminant particles). In various embodiments, the first magnet 102 may produce a magnetic field having a field strength capable of inducing a magnetic charge on the particles of the first powder 106*a* while the field strength is not enough to induce a magnetic charge on the particles of the second powder 106*b*. In various embodiments, the strength of the magnetic field of the first magnet 102 is about 1.5 Tesla or higher. In various embodiments, the magnetic field of the first magnet 102 may be applied at or below room temperatures, i.e, at or below about 25° Celsius.

The second magnet 104 is used to separate the magnetized first powder 106*a* of the powder mixture 108 from the second powder 106*b* of the powder mixture 108. Powder mixture 108 is sent through the magnetic field provided by the second magnet 104. The second magnet 104 may have a magnetic field strength that is less than the magnetic field strength of the first magnet 102 and that is generally less than a field strength needed to magnetize the particles of the first powder 106*a* and of the second powder 106*b*. In one embodiment, the second magnet 104 may be used to produce a magnetic field on a rotating wheel 120 rotating about a horizontal axis. The powder mixture 108 may be introduced to the rotating wheel 120 at the top of the rotating wheel 120. The magnetized particles of the first powder 106*a* adhere to the wheel 120. As the wheel 120 rotates, the particles of the first powder 106*a* and the particles of the second powder 106*b* disengage from the rotating wheel 120 at different angles of rotation. A first bin 110 may be placed at a first location with respect to the wheel 120 to catch the particles of the first powder 106*a* and a second bin 112 may be placed at a second location with respect to the wheel 120 to catch the particles of the second powder 106*b* as they disengage from the wheel 120. In the exemplary separation system 100, first bin 110 may contain the superalloy metal powder while second bin 112 may include the contaminant particles. Other magnetic separation methods employing the second magnet 104 may be used to separate powder mixture 106 into first bin 110 containing first particles 106*a* and second bin 112 containing second particles 106*b* in alternate embodiments.

Figure 2:
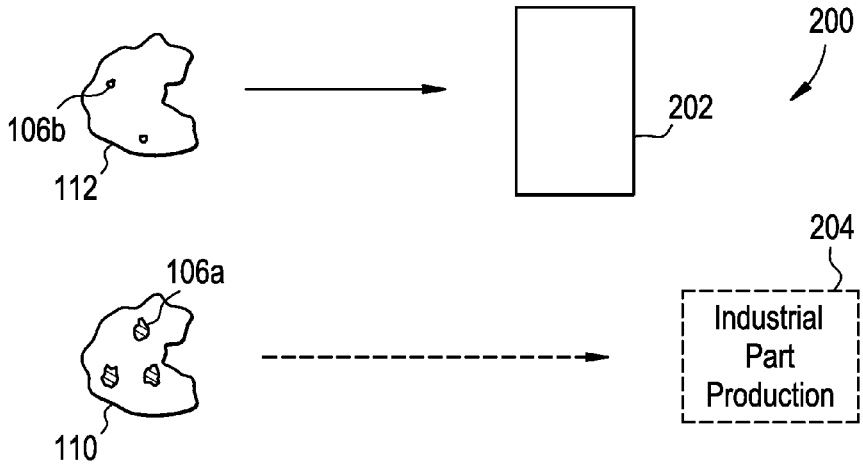
FIG. 2 illustrates an exemplary process for testing a quality of the powder mixture.

FIG. 2 illustrates an exemplary process 200 for testing a quality of the powder mixture 106. The separated second powder 106*b* (i.e., the contaminant particles) from the second bin 112 may be examined for quality control purposes. The contaminant particles may be observed under a tool 202 such as a microscope and a count may be obtained of a number of the contaminant particles. In one embodiment, a size of the contaminant particles may be determined and a count may be obtained of the number of contaminant particles larger that a selected threshold. In an exemplary embodiment, the original powder mixture 106 may be a standard powder sample size from a production lot, such as a 1 lb. Sample from a 500 lb. production lot. An exemplary cleanliness threshold may therefore be a count of 100 or less particles of great size greater than 80 microns or less in size per 1 lb. sample. Thus, a count of less than 20 particles that are greater than 40 microns per 1 lb. sample indicates a sample that is clean enough for use in a subsequent production process. Any particular cleanliness threshold may be used in various embodiments. When the powder mixture 106 is determined to be clean based on the observation of the contaminant particles, the separated first powder 106*a* (i.e., the superalloy metal particles) may be sent for subsequent industrial part production 204.

Figure 3:
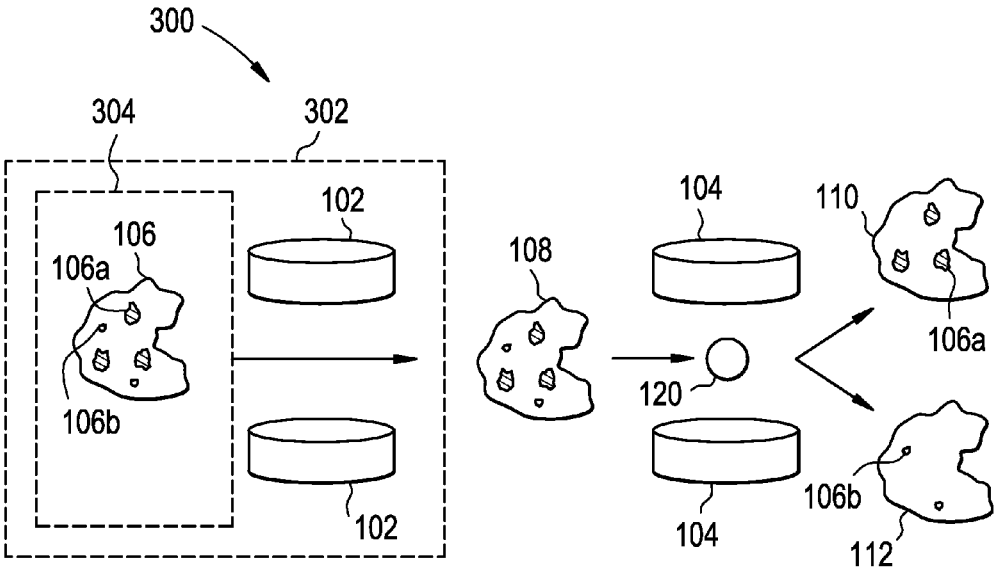
FIG. 3 shows an alternate embodiment of a separation system of the present disclosure.

FIG. 3 shows an alternate embodiment 300 of a separation system of the present disclosure. In the alternate embodiment, the powder mixture 106 is lowered to a freezing temperature or a cryogenic temperature below 0° Celsius. In various embodiments, lowering the temperature of the powder mixture 106 to freezing or cryogenic temperatures increases the responsiveness of the non-magnetic superalloy metal to being magnetized by the first magnetic field of the first magnet 102. In one alternate embodiment, cooling unit 302 contains the first magnet 102 within. The powder mixture 106 is set inside the cooling unit 302 and the first magnetic field is applied to the powder mixture 106 when the powder mixture 106 reaches the selected temperature. In another alternate embodiment, the powder mixture 106 is cooled to the selected temperature in cooling unit 304 and is exposed to the first magnet 102 soon upon removing the powder mixture 106 from the cooling unit 304 before the powder mixture 106 substantially returns to a room temperature.

Figure 4:
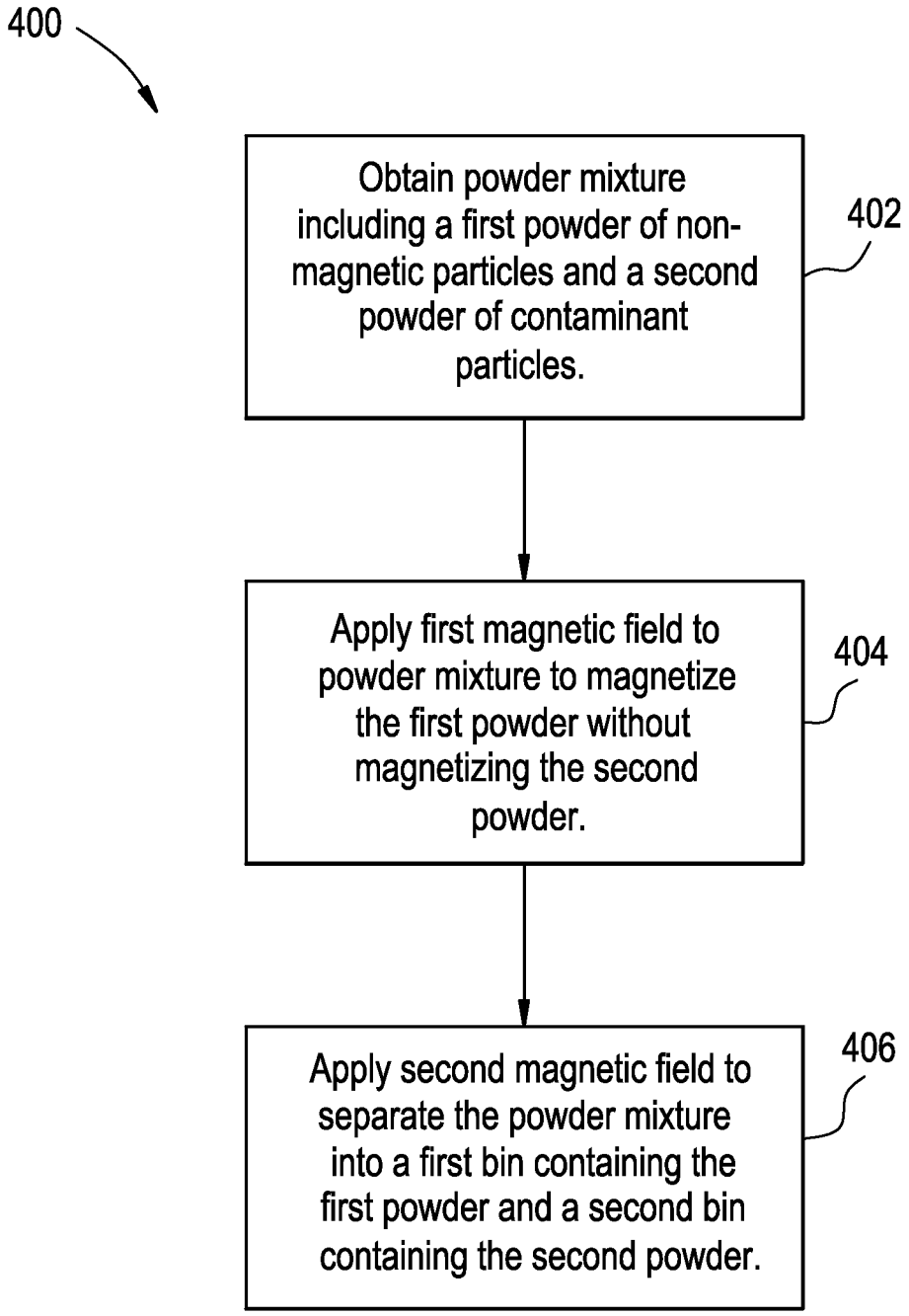
FIG. 4 shows a flowchart illustrating an exemplary method of separating a powder mixture.

FIG. 4 shows a flowchart 400 illustrating an exemplary method of separating a powder mixture in one embodiment of the present disclosure. In Block 402, a powder mixture is obtained that includes a first powder including non-magnetic particles for use in industrial part production and a second power including contaminant particles. In Block 404, a first magnetic field is applied to the powder mixture to magnetize the particles of the first powder while leaving the particles of the second powder un-magnetized. In Block 406, a second magnetic field is applied to the powder mixture obtained in Block 404 to separate the powder mixture into a first bin containing the first powder and a second bin containing the second powder.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A method of separating a powder mixture, comprising:

applying a first magnetic field to the powder mixture containing a non-magnetic metal powder and a contaminant powder, wherein a field strength of the first magnetic field magnetizes the non-magnetic metal powder and leaves the contaminant powder non-magnetized; and applying a second magnetic field to the powder mixture to separate the magnetized metal powder from the non-magnetized contaminant powder.

2. The method of claim 1, wherein the non-magnetic metal powder is at least one of: a superalloy metal powder; a high-alloy nickel chromium powder; a non-magnetic steel powder; a stainless steel powder; a non-ferrous powder; and a copper powder.

3. The method of claim 1 further comprising applying the first magnetic field at or below a room temperature.

4. The method of claim 3, further comprising lowering a temperature of the powder mixture below a freezing point prior to applying the first magnetic field to increase a responsiveness of the non-magnetic metal powder to magnetization by the first magnetic field.

5. The method of claim 1, wherein the field strength of the first magnetic field is greater than about 1.5 Tesla.

6. The method of claim 1, further comprising observing a number of contaminant particles of a selected size in the contaminant powder to determine a cleanliness of the powder mixture.

7. The method of claim 6, further comprising determining a powder mixture to be clean when a number of contaminant particles of a selected size in the separated contaminant powder is less than a selected threshold value.

8. An apparatus for separating a powder mixture, comprising:

a first magnet configured to magnetize a non-magnetic metal powder of the powder mixture and leave a contaminant powder of the powder mixture non-magnetized; and a second magnet configured to separate the magnetized metal powder from the non-magnetized contaminant powder.

9. The apparatus of claim 8, wherein the non-magnetic metal powder is at least one of: a superalloy metal powder; a high-alloy nickel chromium powder; a non-magnetic steel powder; a stainless steel powder; a non-ferrous powder; and a copper powder.

10. The apparatus of claim 8 wherein the first magnet is configured to magnetize the non-magnetic metal powder at or below a room temperature.

11. The apparatus of claim 8, further comprising a cooling unit configured to place the powder mixture at a temperature below a freezing point prior to applying a magnetic field to the first magnet to the powder mixture.

12. The apparatus of claim 8, wherein a field strength of the first magnet greater than about 1.5 Tesla.

13. The apparatus of claim 8, further comprising a tool configured to observe a number of particles of a selected size in the separated contaminant powder.

14. The apparatus of claim 13, wherein the powder mixture is considered to be clean when a number of particles of a selected size in the separated contaminant powder is less than a selected threshold value.

15. A method of separating a powder mixture, comprising:

applying a first external magnetic field to the powder mixture having a first powder that is non-magnetic and a second powder that is non-magnetic in order to magnetize the first powder and leave the second powder in a non-magnetized state; and using a second external magnetic field to separate the first powder from the second powder.

16. The method of claim 15, wherein the first powder includes at least one of: a superalloy metal powder; a high-alloy nickel chromium powder; a non-magnetic steel powder; a stainless steel powder; a non-ferrous powder; and a copper powder, and the second powder includes contaminants.

17. The method of claim 15 further comprising applying the first external magnetic field at or below a room temperature.

18. The method of claim 15 further comprising lowering a temperature of the powder mixture below a freezing point prior to applying the first external magnetic field.

19. The method of claim 15, wherein a field strength of the first external magnetic field is greater than about 1.5 Tesla.

20. The method of claim 15, further comprising counting a number of particles of a selected size in the second powder separated from the first powder to determine a cleanliness of the powder mixture.

* * * * *